US010730690B2

(12) United States Patent
Dodd et al.

(10) Patent No.: US 10,730,690 B2
(45) Date of Patent: Aug. 4, 2020

(54) AEROSOL DISPENSER HEAD WITH LOCKING FEATURE

(71) Applicant: Silgan Dispensing Systems Corporation, Grandview, MO (US)

(72) Inventors: Joseph K. Dodd, Lee's Summit, MO (US); Brian K. Van Houten, Kansas City, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

(21) Appl. No.: 16/326,339

(22) PCT Filed: Aug. 22, 2017

(86) PCT No.: PCT/US2017/047921
§ 371 (c)(1),
(2) Date: Feb. 18, 2019

(87) PCT Pub. No.: WO2018/039175
PCT Pub. Date: Mar. 1, 2018

(65) Prior Publication Data

US 2019/0218020 A1 Jul. 18, 2019

Related U.S. Application Data

(60) Provisional application No. 62/378,273, filed on Aug. 23, 2016.

(51) Int. Cl.
*B65D 83/22* (2006.01)
*B65D 83/40* (2006.01)

(52) U.S. Cl.
CPC ..... *B65D 83/22* (2013.01); *B65D 83/40* (2013.01)

(58) Field of Classification Search
CPC . B05B 11/0027; B05B 11/3059; B65D 83/22; B65D 2215/02; B65D 83/56
USPC ..... 222/153.11, 153.13
See application file for complete search history.

(56) References Cited

U.S. PATENT DOCUMENTS

| | | | | |
|---|---|---|---|---|
| 3,608,785 | A | 9/1971 | Durso et al. | |
| 3,738,537 | A | 6/1973 | Gach | |
| 3,828,982 | A * | 8/1974 | Steigerwald | B65D 50/045 222/153.11 |
| 3,918,614 | A | 11/1975 | Steiman | |
| 4,582,228 | A * | 4/1986 | Diamond | B65D 83/205 222/153.11 |
| 5,282,551 | A * | 2/1994 | Pierson | B65D 83/205 222/153.11 |
| 2003/0127468 | A1* | 7/2003 | Loghman-Adham | B65D 83/205 222/153.14 |
| 2008/0061087 | A1* | 3/2008 | Reedy | B65D 83/205 222/402.15 |
| 2009/0183744 | A1* | 7/2009 | Hayton | A61M 11/007 131/270 |
| 2012/0248129 | A1 | 10/2012 | Yoshida et al. | |

* cited by examiner

*Primary Examiner* — Paul R Durand
*Assistant Examiner* — Robert K Nichols, II
(74) *Attorney, Agent, or Firm* — Barlow, Josephs & Holmes, Ltd.

(57) ABSTRACT

The invention relates to a locking feature for an aerosol dispenser head having a locking feature incorporating a locking yoke that requires multiple motions to unlock, and a single motion to reengage the locking feature.

18 Claims, 7 Drawing Sheets

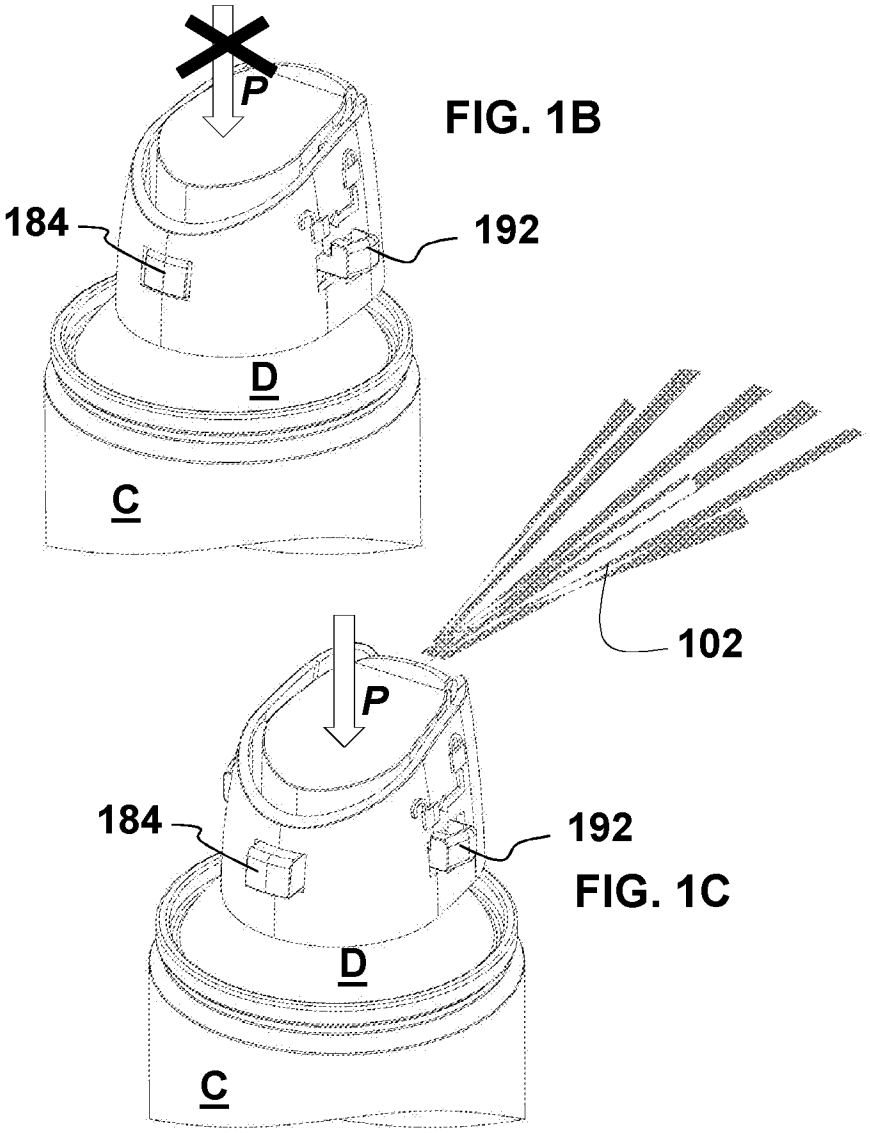
FIG. 1B
FIG. 1C
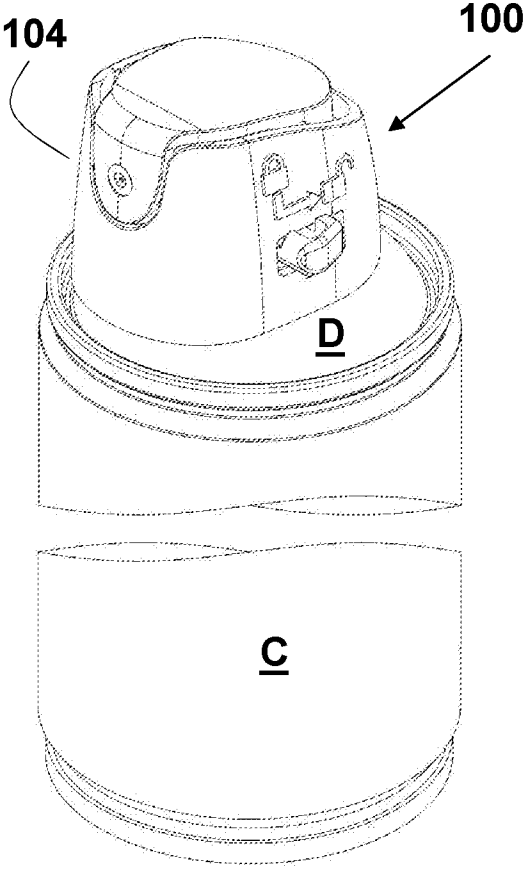
FIG. 1A

AEROSOL DISPENSER HEAD WITH LOCKING FEATURE

BACKGROUND OF THE INVENTION

Field of the Invention

This invention relates to a locking feature for a button actuated aerosol dispenser head.

Description of Related Art

Every year consumers use thousands of aerosol spray cans for materials such as paint, lubricants, cleaners, garden chemicals and the like. In one form, the output from such a spray can is dispensed by pressing a small button valve attached to the top of the pressurized can. Product under pressure flows from the can upward through the button valve, where it is turned ninety degrees and atomized in a horizontal direction. The small button may be uncomfortable since the full force required to move the valve is exerted by only a small area on the fingertip. The small button may also be messy as the fingertip is very close to the atomized spray, and may be wetted by the spray. Often an aerosol dispenser may be provided with a dispensing head having a larger area for actuating the valve. Such a dispensing head is shown in FIG. 1. The dispenser may interest children who may then spray the contents with messy or unhealthy effects. To prevent children from such use, a child-resistant locking mechanism is desired.

SUMMARY OF THE INVENTION

In some embodiments of the invention, a safe and reliable locking feature is provided for use on an aerosol dispenser head.

Accordingly, one embodiment is a dispenser with a locking feature, where the dispenser includes a shroud with a pair of lateral windows and a back window formed therein; an actuator for movement within the shroud from a rest position to a dispensing position; a yoke positioned within the shroud, the yoke having a blocking surface for restricting movement of the actuator in a locked configuration of the yoke; a pair of lateral arms biased to extend outward through the lateral windows; and a reset button positioned to extend outward through the back window in an unlocked configuration of the yoke.

Another embodiment is a method for operating a dispenser having a housing with a pair of lateral windows and a back window formed therein, and an locking feature provided by an internal yoke with a pair of lateral yoke arms, where the method includes (1) first pressing downward on each lateral yoke arm; (2) then pressing inward on each lateral yoke arm; (3) then moving each lateral yoke arm backward causing the yoke to move backward; wherein backward movement of the yoke is inhibited until steps (1) and (2) have been carried out; and wherein backward movement of the yoke moves a blocking surface on the yoke from obstructing downward movement of an actuator; and wherein subsequent downward movement of the actuator causes product to be released from the dispenser.

All of the embodiments are intended to be within the scope of the invention herein disclosed. These and other embodiments of the present invention will become readily apparent to those skilled in the art from the following detailed description of embodiments having reference to the attached figures, the invention not being limited to any particular embodiment(s) disclosed.

For purposes of summarizing the invention and the advantages achieved over the prior art, certain aspects and advantages of the invention have been described herein above. Of course, it is to be understood that not necessarily all such aspects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

FIG. 1A illustrates a front perspective view of a dispenser head, on an aerosol can;

FIG. 1B illustrates a rear perspective view of a dispenser head, in a locked configuration;

FIG. 1C illustrates a rear perspective view of a dispenser head in an unlocked configuration;

DETAILED DESCRIPTION

Figure 2C:
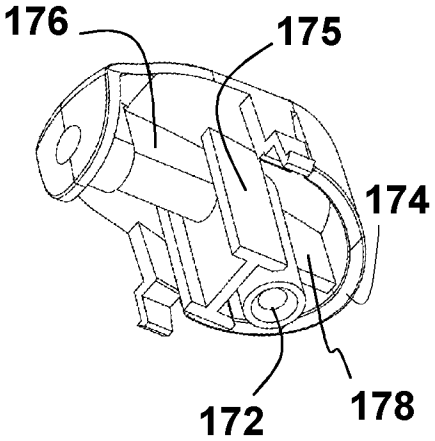
FIG. 2C shows another perspective view of an actuator button of a dispenser head.

FIG. 1A illustrates a front view of a dispenser head 100 mounted on an aerosol can C, for example by attachment to an upper rim 122 (see FIG. 5B) of a dome D on aerosol can C. A lock feature may be provided to selectively prevent such dispensing. FIG. 1B illustrates a rear view of a dispenser head 100 in a locked configuration, and FIG. 1C illustrates a rear view in an unlocked configuration. For moving the dispenser head back and forth between locked and unlocked configurations, side buttons 192 and reset button 184 may be used. In its unlocked configuration, dispenser head 100 may dispense a spray pattern 102 (such as a mist or stream) from an outlet 104 such as an orifice cup that may impart desired flow dynamics. Aerosol dispenser head 100 may be actuated by a pressure P as will be described below.

Figure 2B:
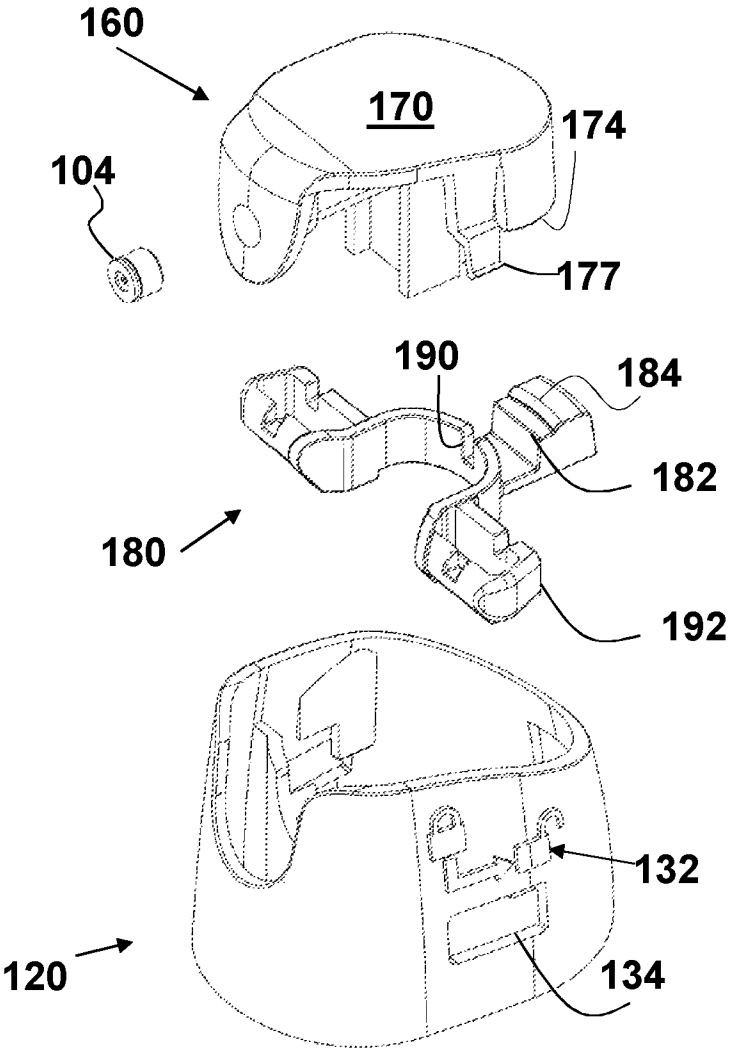
FIG. 2B shows a perspective view of component parts of a dispenser head.
Figure 2A:
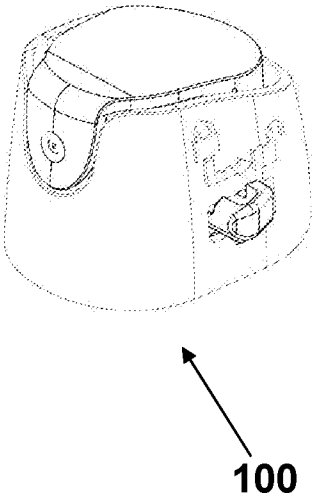
FIG. 2A shows a perspective view of a dispenser head, separate from an aerosol can.

FIG. 2A shows a perspective view of a dispenser head 100 according to various embodiments of the invention, separate from the aerosol can.

FIG. 2B shows a perspective view of the component parts of dispenser head 100, which may include a wrap-around housing or shroud 120, an actuator button 160, and a locking yoke 180. The parts may each be made or constructed of a material such as plastic and may be formed by injection molding. FIG. 2C shows an underside view of actuator button 160.

Shroud 120 may have, along its lower edge, features 124 (best seen in FIG. 3B) that attach to upper rim 122 of the aerosol can, for example by a snap-fit connection. Certain openings provided in shroud 120 may accommodate locking yoke 180. Likewise, markings 132 may be formed in the outer surface of shroud 120 to explain or suggest the operation of the locking feature.

Actuator 160 may include, besides outlet 104, an actuator surface 170 to receive a force that may be transferred to dispenser stem 172 that may in turn depress and open aerosol container valve 173, so that product may travel up through hollow dispenser stem 172 and outlet conduit 176, and out through outlet 104. Actuator 160 may have an actuator rear skirt 174 that moves down when actuator surface 170 is pressed. In the locked configuration, blocking surface 182 of yoke 180 may interfere with actuator rear skirt 174 to prevent the dispenser from actuating. In the unlocked configuration, reset button 184 may extend outward of the dispenser to facilitate returning yoke 180 forward into the locked configuration. Buttresses 175 may be provided on the sides of actuator 160 to limit the inward travel of yoke arms 192.

To assemble the parts together, yoke arms 192 may be flexed inward and yoke 180 installed within shroud 120, with yoke arms 192 protruding outward through side button windows 134 and reset button 184 positioned in rear button window 136. Actuator 160 may then be lowered into shroud 120 and assembly fingers 177 may snap into receiving areas within shroud 120.

Figure 3A:
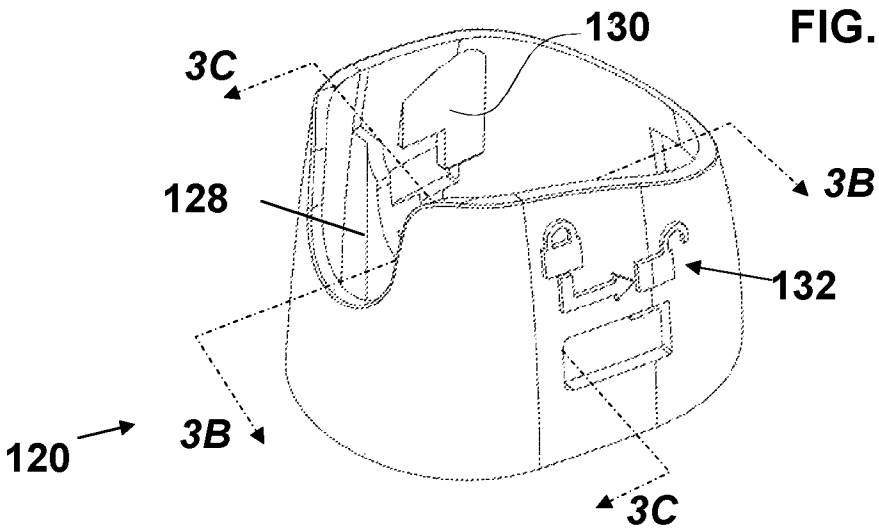
FIG. 3A shows a perspective view of a shroud of a dispenser head.

FIG. 3A shows a perspective view of shroud 120. Besides attachment features 124 and markings 132, shroud 120 according to various embodiments of the invention may include structural ribs 128. Shroud 120 may also include locking ribs 130, side button windows 134, and rear button window 136. FIG. 3A shows dividing lines 3B and 3C that correspond to the views shown in FIG. 3B and FIG. 3C respectively.

Figure 3B:
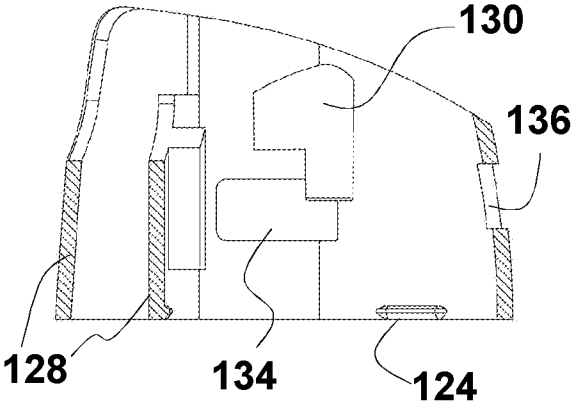
FIG. 3B shows a side view cross section of a shroud.
Figure 3C:
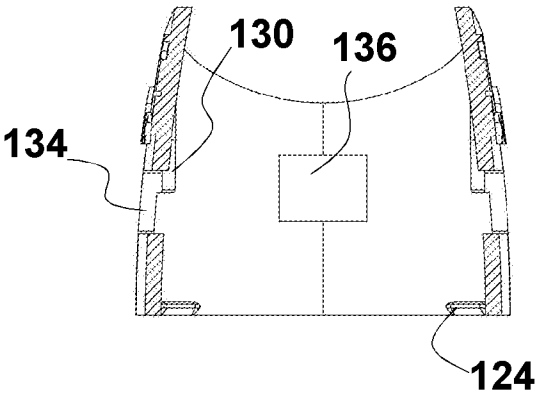
FIG. 3C shows a front view cross section of a shroud.

FIG. 3B shows a cross sectional view of shroud 120, seen from the side. FIG. 3C shows a perspective view cross section of housing 120. FIG. 3D shows a front view cross section of housing 120.

Figures 4A, 4B:
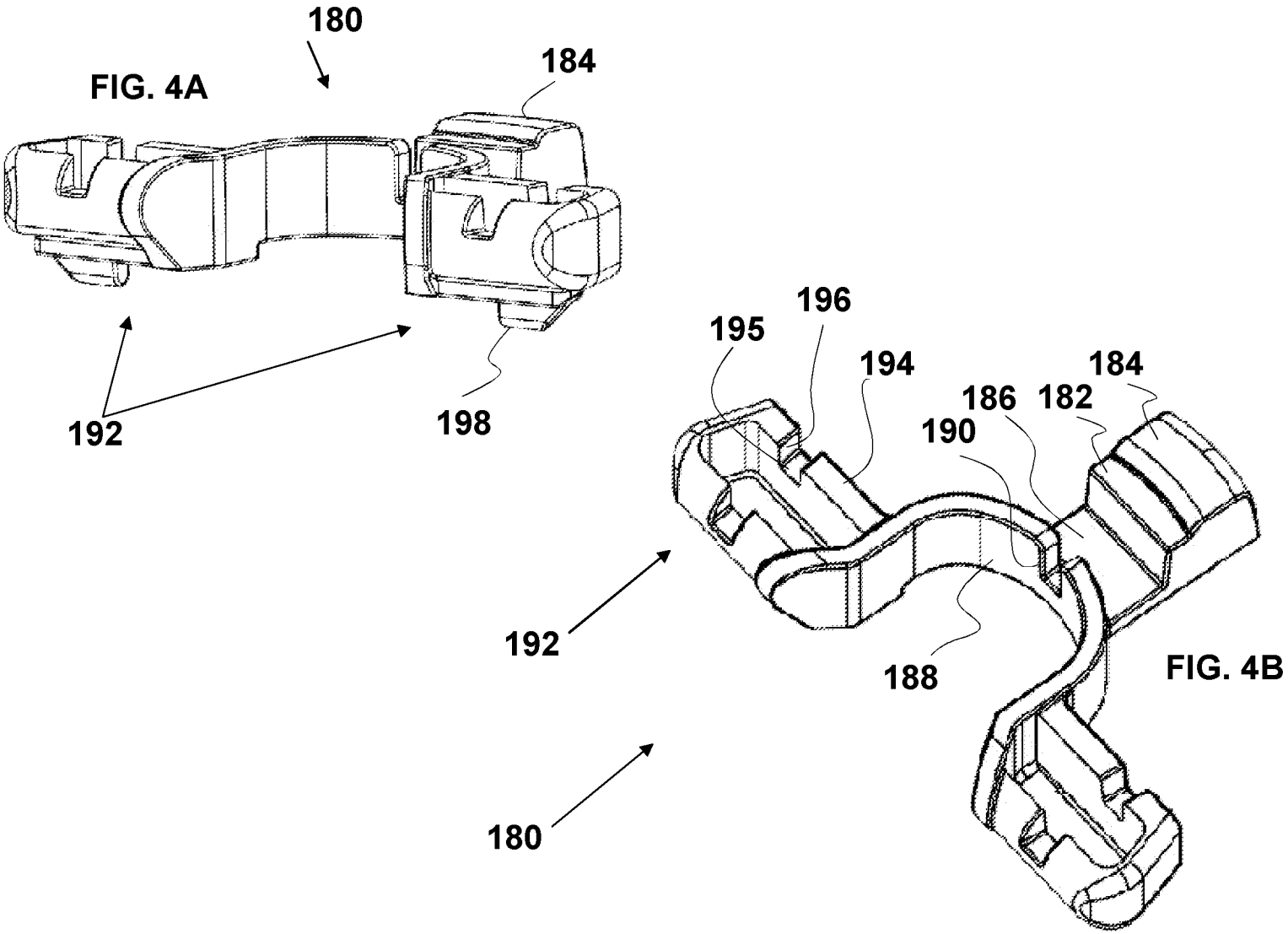
FIG. 4A shows a front perspective view of a locking yoke component.
FIG. 4B shows a top perspective view of a locking yoke.

FIG. 4A shows a front perspective view of a locking yoke 180 according to various embodiments of the invention. FIG. 4B shows a top perspective view of locking yoke 180. Locking yoke 180 may have a blocking surface 182 to prevent product dispensing by blocking actuator rear skirt 174. When locking yoke 180 is moved to an unlocked position, blocking surface 182 may move into rear button window 136 and reset button 184 having passed through rear button window 136 may rise slightly and may keep dispenser head 100 in the unlocked position by preventing yoke 180 from moving forward. In the unlocked position, when actuator surface 170 is depressed, actuator rear skirt 174 may drop into gutter 186 and permit product dispensing.

To return to the locked configuration, reset button 184 may be depressed and pushed forward through rear button window 136, moving yoke 180 back into the locked position.

Reset button 184 and blocking surface 182 may be connected to collar 188 that may extend around an arc of about 180 degrees and may connect at each end to yoke arms 192, which may extend through side button windows 134 in shroud 120. Yoke arms 192 may be open in the center as shown, forming an approximately U-shaped structure, or they may be solid. Yoke arms 192 may include blocking walls 194 in which may be formed keyways 195. The lower surfaces of yoke arms 192 may include springs or ramps 198 that may help bias yoke arms 192 upward in the locked configuration, and may help resist the downward force used in the initial step of unlocking dispenser 100. Collar 188 may have one or more collar slots 190 formed therein to adjust the stiffness of collar 188 or to help guide movement of yoke 180, for example by sliding along fin 178 within actuator 160. The materials and dimensions of collar 188 may also help determine the stiffness.

Collar 188 may be rigid enough to provide an outward force upon yoke arms 192 sufficient to resist the inward force required to unlock dispenser head 100. However, collar 188 may still be flexible enough to permit yoke arms 192 to move inward upon sufficient force. Buttresses 175 may limit the inward movement of yoke arms 192 and may help ensure that the movement of one yoke arm 192 does not cause movement of the other yoke arm. Within actuator 160, rear fin 178 may be provided that may interact with collar slot 190 to help guide the movement of yoke 180.

Figure 5B:
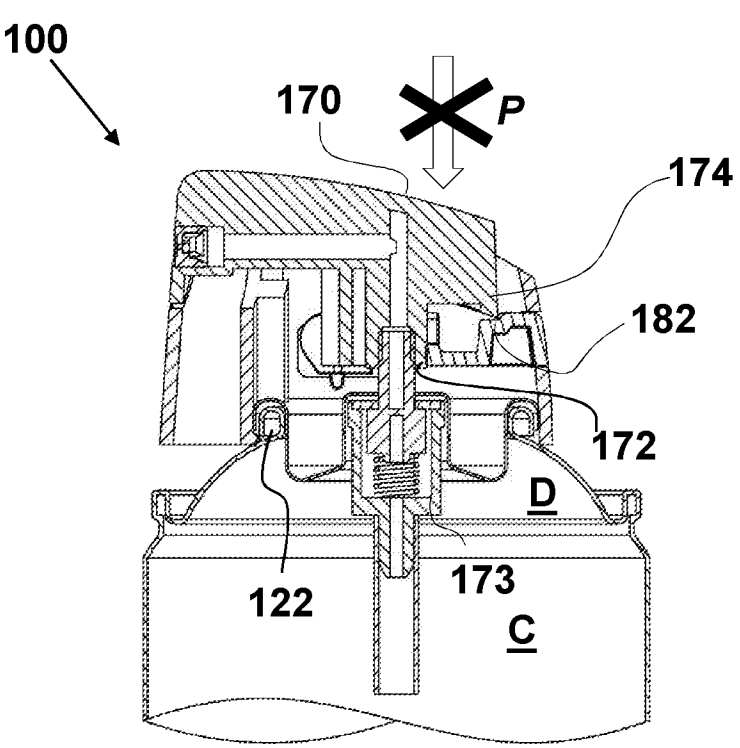
FIG. 5B shows a cross section side view of a dispenser head in a locked configuration.
Figure 5A:
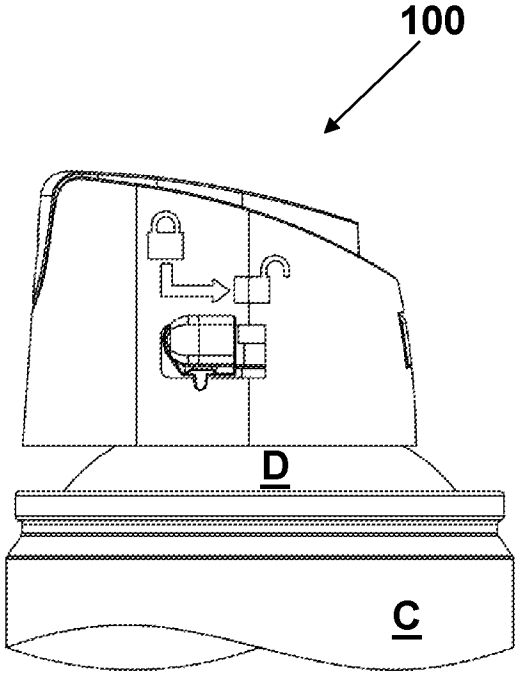
FIG. 5A shows a side view of a dispenser head in a locked configuration.

FIG. 5A shows a side view of a dispenser head 100 according to certain embodiments of the invention in a locked configuration. FIG. 5B shows a corresponding cross section side view of dispenser head 100 in the locked configuration. Despite a downward force P on actuator surface 170, dispenser stem 172 may be prevented from moving downward against container valve 173 because actuator rear skirt 174 is blocked by blocking surface 182.

Figure 6B:
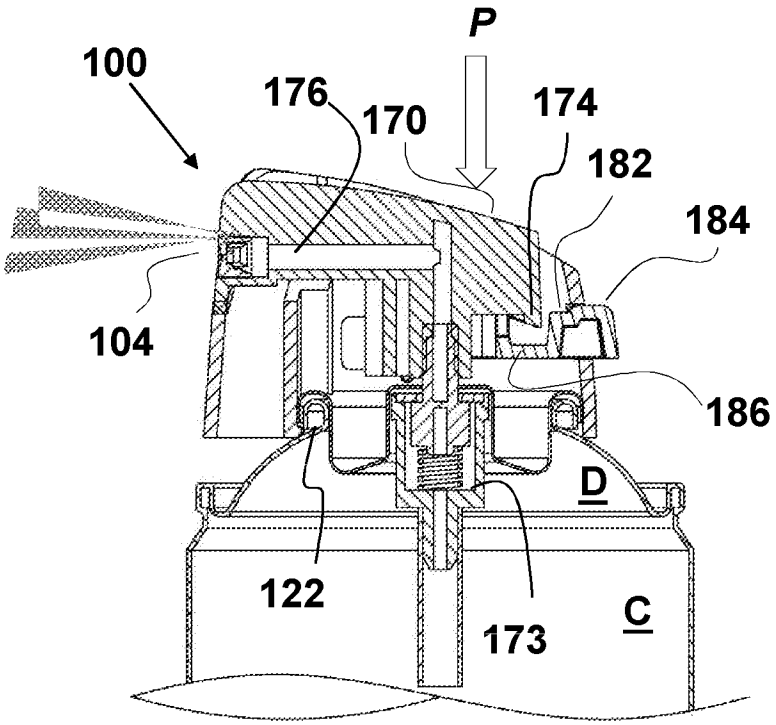
FIG. 6B shows a cross section side view of a dispenser head in an unlocked configuration.
Figure 6A:
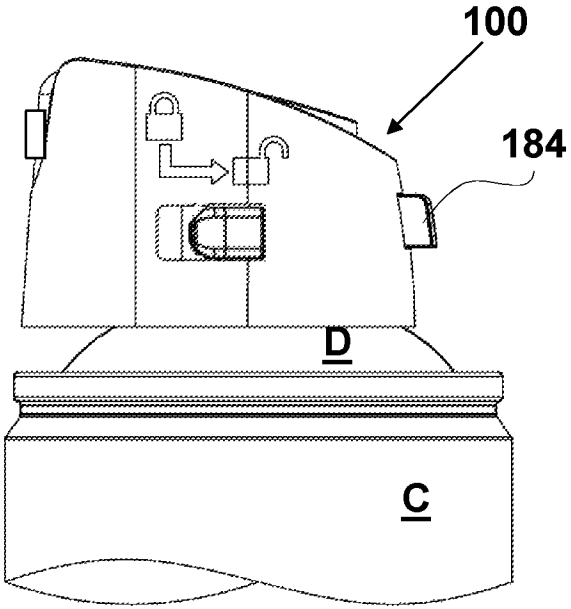
FIG. 6A shows a side view of a dispenser head in an unlocked configuration.

FIG. 6A shows a side view of dispenser head 100 in an unlocked configuration. FIG. 6B shows a corresponding cross section side view of dispenser head 100 in the unlocked configuration. When a downward force P is applied on actuator surface 170 as illustrated in FIG. 6B, dispenser stem 172 is free to move downward against container valve 173 because actuator rear skirt 174 drops into gutter 186. Movement of container valve 173 releases product up through dispenser stem 172 and outlet conduit 176 to outlet 104. Meanwhile blocking surface 182 may move into rear button window 136 and may hold yoke 180 in the unlocked position. However, downward/forward pressure on reset button 184 may move yoke 180 back into the locked position.

Figure 7B:
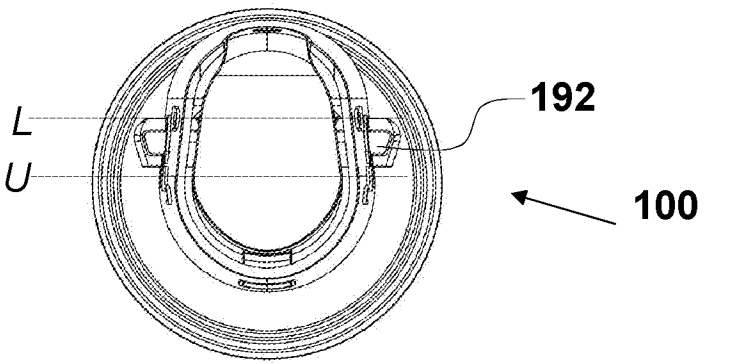
FIG. 7B shows a top view of a dispenser head in a locked configuration, corresponding to FIG. 7A.
Figure 7D:
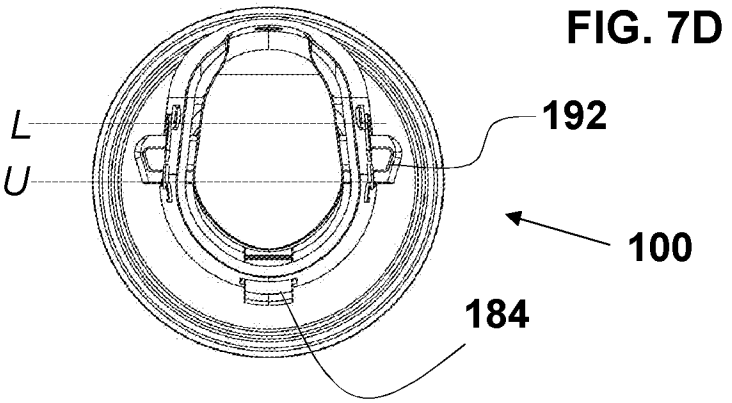
FIG. 7D shows a top view of a dispenser head in an unlocked configuration, corresponding to FIG. 7C.
Figure 7A:
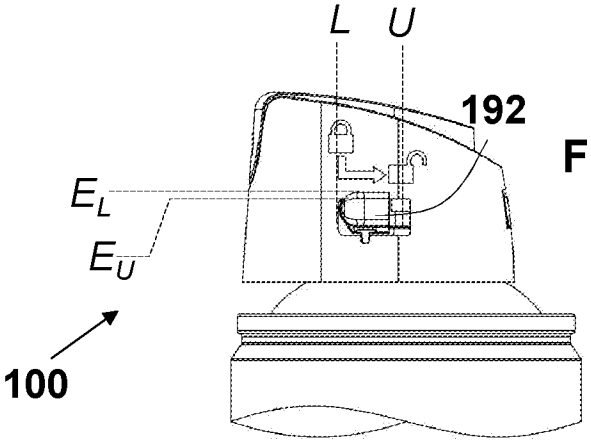
FIG. 7A shows a detail side view of a dispenser head in a locked configuration.
Figure 7C:
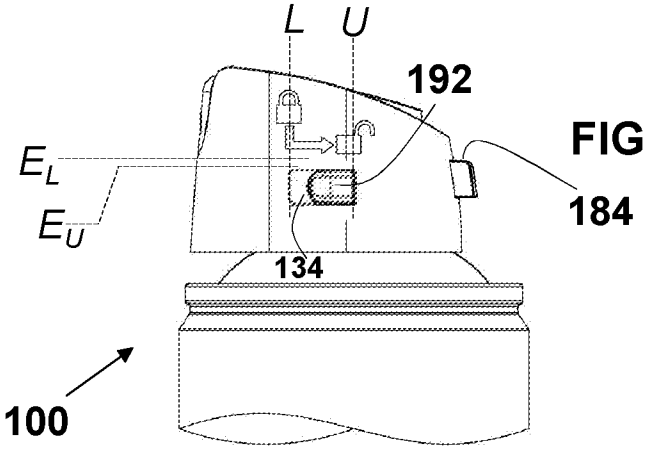
FIG. 7C shows a detail side view of a dispenser head in an unlocked configuration.

FIG. 7A shows a detail side view of dispenser head 100 in a locked configuration, while FIG. 7B shows a corresponding top view. FIG. 7C shows a side view in an unlocked configuration; and FIG. 7D shows a corresponding top view. Reference may be made to structural details of FIGS. 3B and 4B.

In the locked configuration, each of yoke arms 192 may be prevented from moving backward because blocking wall 194 (FIG. 4B) runs into locking rib 130 (FIG. 3C). Furthermore, yoke arm 192 may not be able to move inward because surface 196 of keyway 195 may be blocked by the upper edge of side button window 134. To unlock dispenser head 100, each of yoke arms 192 may first be pressed downward from locked elevation $E_L$ to unlocked elevation $E_U$ (elevations with respect to the upper surface of yoke arms 192) as illustrated in FIG. 7A, which may bring yoke arm 192 into vertical alignment with side button window 134, so that surface 196 is no longer blocked by housing wall above side button window 134. Next, each yoke arm 192 may be pressed inward so that blocking wall 194 may clear locking rib 130. Now keyway 195 may be aligned with locking rib 130, but keyway 195 may be large enough that locking rib 130 may pass through keyway 195. Now, still keeping yoke arms 192 pressed inward, yoke arms 192 may be slid backward in side button windows 134 from locked position L to unlocked position U (positions with respect to the front surface of yoke arm 192). This may move yoke 180 backwards, including blocking surface 182 so that it may no longer block actuator rear skirt 174. Instead, actuator rear skirt 174 may be free to drop into gutter 186 to allow product dispensing. Meanwhile blocking surface 182 may move through rear button window 136 at which point reset button 184 may flex slightly upward and out of rear button window 136, and may hold locking yoke 180 in the unlocked position.

To return dispensing head 100 to the locked configuration, reset button 184 may be pressed inward (forward) which may move blocking surface 182 back to its locked position where it may prevent downward movement of actuator rear skirt 174. Yoke arms 192 also may move forward until keyways 195 clear locking ribs 130. This allows yoke arms 192 to flex outward and move out slightly through side button windows 134. Once yoke arms 192 move sufficiently out through side button windows 134, keyways 195 may clear the upper edge of side button windows 134, and yoke arms 192 may then flex back upward to their fully locked position.

It is thus seen that the dispensing head 100 provides a locking feature that requires multiple actions to unlock—downward pressing of the yoke arms on both sides, inward pressing on both sides, and backward sliding on both sides, in that specific order. Moreover, dispensing head 100 may be returned to its locked configuration by a single motion—pressing the reset button forward. This dispensing head 100 provides a locking feature that should be challenging for a child, and one that is highly unlikely to be unlocked by random movement within a package during shipping.

While certain embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

The invention claimed is:

1. A dispenser with a locking feature, comprising:
- a shroud with a pair of lateral windows and a back window formed therein;
- an actuator for movement within the shroud from a rest position to a dispensing position; and
- a yoke positioned within the shroud, the yoke comprising
  - a blocking surface for restricting movement of the actuator in a locked configuration of the yoke;
  - a pair of lateral arms biased to extend outward through the lateral windows; and
  - a reset button positioned to extend outward through the back window in an unlocked configuration of the yoke.

2. The dispenser of claim 1, wherein the lateral arms each comprise a spring member that biases the lateral arm upward.

3. The dispenser of claim 1, wherein the lateral arms each comprise a keyway to engage an edge of its respective lateral window and resist inward movement of the lateral arm until the lateral arm is pressed downward.

4. The dispenser of claim 1, wherein the shroud comprises a blocking member to resist backward movement of each lateral arm until the lateral arm is pressed inward.

5. The dispenser of claim 1, where inward movement of the lateral arms is limited by at least one buttress within the dispenser.

6. The dispenser of claim 1, wherein the yoke is sufficiently flexible to be assembled into the shroud during an assembly step.

7. A dispenser with a locking feature, comprising:
- a shroud with a pair of lateral windows and a back window formed therein;
- an actuator for movement within the shroud from a rest position to a dispensing position; and
- a yoke positioned within the shroud, the yoke comprising
  - a blocking surface for restricting movement of the actuator in a locked configuration of the yoke;
  - a pair of lateral arms biased to extend outward through the lateral windows; and
  - a reset button positioned to extend outward through the back window in an unlocked configuration of the yoke,
- wherein movement of the yoke from a locked configuration requires as a first step a downward movement of both lateral arms.

8. The dispenser of claim 7, wherein movement of the yoke from a locked configuration requires as a second step an inward movement of both lateral arms.

9. The dispenser of claim 8, wherein movement of the yoke from a locked configuration requires as a third step a backward movement of both lateral arms.

10. The dispenser of claim 9, wherein the first step, second step, and third step are done in consecutive order to move the yoke from a locked configuration to an unlocked configuration.

11. The dispenser of claim 9, wherein backward movement of both lateral arms causes the yoke to move backward to an unlocked configuration wherein the blocking surface no longer restricts movement of the actuator.

12. The dispenser of claim 11, wherein backward movement of the yoke allows the reset button to move through the back window and flex upward to hold the yoke in the unlocked configuration.

13. The dispenser of claim 12, wherein a downward and forward pressure on the reset button releases the yoke from the unlocked configuration and allows the yoke to return to the locked configuration.

14. A method for operating a dispenser having a housing with a pair of lateral windows and a back window formed therein, and an locking feature provided by an internal yoke with a pair of lateral yoke arms, the method comprising:
- (1) first pressing downward on each lateral yoke arm;
- (2) then pressing inward on each lateral yoke arm;
- (3) then moving each lateral yoke arm backward causing the yoke to move backward;
- wherein backward movement of the yoke is inhibited until steps (1) and (2) have been carried out;
- wherein backward movement of the yoke moves a blocking surface on the yoke from obstructing downward movement of an actuator; and wherein subsequent downward movement of the actuator causes product to be released from the dispenser.

15. The method of claim 14, wherein backward movement of the yoke moves a reset button out through the back window.

16. The method of claim 15, wherein the reset button after moving partly through the back window is biased to engage the back window and hold the yoke in the unlocked configuration.

17. The method of claim 15, wherein a forward pressure on the reset button moves the yoke back to the locked configuration.

18. The method of claim 15, wherein a downward and forward pressure on the reset button moves the yoke back to the locked configuration.

* * * * *